US006663369B2

(12) United States Patent
Hirayama

(10) Patent No.: US 6,663,369 B2
(45) Date of Patent: Dec. 16, 2003

(54) FLUID COMPRESSOR

(75) Inventor: Takuya Hirayama, Fujisawa (JP)

(73) Assignee: Toshiba Carrier Corporation, Tokyo (JP)

( * ) Notice: Subject to any disclaimer, the term of this patent is extended or adjusted under 35 U.S.C. 154(b) by 0 days.

(21) Appl. No.: 10/359,181

(22) Filed: Feb. 6, 2003

(65) Prior Publication Data

US 2003/0118465 A1 Jun. 26, 2003

Related U.S. Application Data

(63) Continuation of application No. PCT/JP01/06338, filed on Jul. 23, 2001.

(30) Foreign Application Priority Data

Aug. 9, 2000 (JP) ..... 2000-241523

(51) Int. Cl.[7] ..... F01C 21/08
(52) U.S. Cl. ..... 418/220
(58) Field of Search ..... 418/220

(56) References Cited

U.S. PATENT DOCUMENTS 4,872,820 A * 10/1989 Iida et al. ..... 418/220
5,332,377 A 7/1994 Hirayama et al.

FOREIGN PATENT DOCUMENTS

| | | |
|---|---|---|
| JP | 2/99283 | 8/1990 |
| JP | 7-107391 | 11/1995 |
| JP | 8-82295 | 3/1996 |
| JP | 2602869 | 1/1997 |

* cited by examiner

*Primary Examiner*—Thomas Denion
*Assistant Examiner*—Theresa Trieu
(74) *Attorney, Agent, or Firm*—Pillsbury Winthrop LLP

(57) ABSTRACT

A roller is provided in a hollow cylinder and is eccentric with the axis of the cylinder. A helical groove is made in the outer circumferential surface of the roller. A blade is fitted in the helical groove and can move into and from the helical groove. The blade forms a plurality of compression chambers between the cylinder and the roller. Coolant gas is gradually compressed in the compression chambers. The helical groove has two opposing sides. One side positioned at a high-pressure compression chamber is inclined to the other side such that the groove gradually opens toward the outer circumferential surface of the roller.

1 Claim, 6 Drawing Sheets

FLUID COMPRESSOR

CROSS-REFERENCE TO RELATED APPLICATIONS

This is a Continuation Application of PCT Application No. PCT/JP01/06338, filed Jul. 23, 2001, which was not published under PCT Article 21 (2) in English.

This application is based upon and claims the benefit of priority from the prior Japanese Patent Application No. 2000-241523, filed Aug. 9, 2000, the entire contents of which are incorporated herein by reference.

BACKGROUND OF THE INVENTION

1. Field of the Invention

The present invention relates to a fluid compressor of helical-blade type that constitutes, for example, the refrigeration cycle of an air conditioner.

2. Description of the Related Art

Reciprocating compressors and rotary compressors are known as compressors for use in, for example, refrigeration cycles of air conditioners. These compressors may become debased in sealing property or may be complicated in structure.

Recently, it is proposed that helical-blade type compressors be used in place of reciprocating compressors or rotary compressors. This is because helical-blade type compressors are relatively simple in structure, has improved sealing property and can compress fluid with high efficiency. In addition, the components of a helical-blade type compressor are easy to manufacture and assemble.

FIG. 11 shows a part of a helical type compressor. In this helical-blade type compressor, the roller 102 is eccentrically arranged in the fixed cylinder 101 and has a helical groove 103 in its outer circumferential surface. A blade 104 is fitted in the groove 103 such that it can move in the depth direction of the groove 104.

As the roller 102 revolves, the blade 104 divides the space between the cylinder 101 and the roller 102 into a plurality of compression chambers 105. Each compression chamber has a smaller volume than the immediately adjacent chamber that is more close to one end of the roller 102. The coolant gas introduced into the compression chamber 105 at that end of the roller 102 is gradually compressed to a high pressure until it is forced out of the compression chamber 105 provided at the other end of the roller 102.

As FIG. 12 shows, the helical groove 103 and the blade 104 have a rectangular cross section, taken along a line extending at right angles to their axes. Having a rectangular cross section, the helical groove 103 is easy to cut in the outer circumferential surface of the roller 102.

The blade 104 has a width a little smaller than the width of the helical groove 103. In other words, the widths of the groove 103 and blade 104 are predetermined so that the blade 104 can move in the depth direction of the helical groove 103.

Since the helical groove 103 and the blade 104 have a rectangular cross section, the blade 103 remains in contact with both sides of the helical groove 103 even when it completely lies within the helical groove 103.

Hence, the bottom space 106 defined between the lower surface of the blade 104 and the bottom of the helical groove 103 cannot sufficiently communicate with the high-pressure compression chamber 105A.

Consequently, the pressure of the coolant gas in the bottom space 106, which lies at the bottom of the helical groove 103, is lower than the pressure in the high-pressure compression chamber 105A. The coolant gas is inevitably forced out at a low pressure. Thus, the coolant gas cannot gain an optimal pressure rise. This may result in a decrease of compression efficiency.

When the blade 104 protrudes from the helical groove 103 to a maximum degree, it receives the highest possible pressure. At this time, the blade 104 is most deformed and cannot smoothly move with respect to the helical groove 103. This may degrade the sealing property of the compressor.

In the process of assembling the compression mechanism unit, the blade 104 having a rectangular cross section must be fitted into the helical groove 103 having a rectangular cross section. This work is extremely cumbersome, lowering the efficiency of assembling the compression mechanism unit.

An object of the present invention is to provide a fluid compressor in which the bottom space lying at the bottom of the helical groove can easily communicate with the high-pressure compression chamber to enhance the compression efficiency, and the blade can smoothly move with respect to the helical groove to improve the sealing property.

BRIEF SUMMARY OF THE INVENTION

A fluid compressor according to the present invention comprises:

a hollow cylinder;

a roller provided in the cylinder, with an axis deviated from the axis of the cylinder, and having a helical groove made in an outer circumferential surface and having turns arranged at a pitch that gradually increases from one end to the other end;

a blade fitted in the helical groove of the roller and being movable with respect to the helical groove; and a plurality of compression chambers provided between the cylinder and the roller, defined by the blade and designed to compress the fluid to a high pressure gradually as the fluid flows in an axial direction of the roller, from one end to the other end of the roller, wherein the helical groove has one side positioned at a high-pressure compression chamber and another side positioned at a low-pressure compression chamber, and the one side and the another side are inclined at the same angle such that the groove gradually opens toward the outer circumferential surface of the roller, an opening angle θ defined by the one side and another side is:

$$0° < \theta \leqq 20°,$$

the blade has one side positioned at a high-pressure compression chamber and another side positioned at a low-pressure compression chamber, and both sides of the blade are inclined at substantially the same angle as both sides of the helical groove."

The helical groove has one side positioned at a high-pressure compression chamber and another side positioned at a low-pressure compression chamber, and the one side is inclined to the another side such that the groove gradually opens toward the outer circumferential surface of the roller.

Thus, a gap develops between one side of the helical groove and one side of the blade, which opposes the side of the groove, when the blade moves, protruding from the helical groove. The space lying at the bottom of the helical groove therefore reliably communicates with the high-pressure compression chamber.

DETAILED DESCRIPTION OF THE INVENTION

Embodiments of this invention will be described, with reference to the accompanying drawings.

Figure 1:
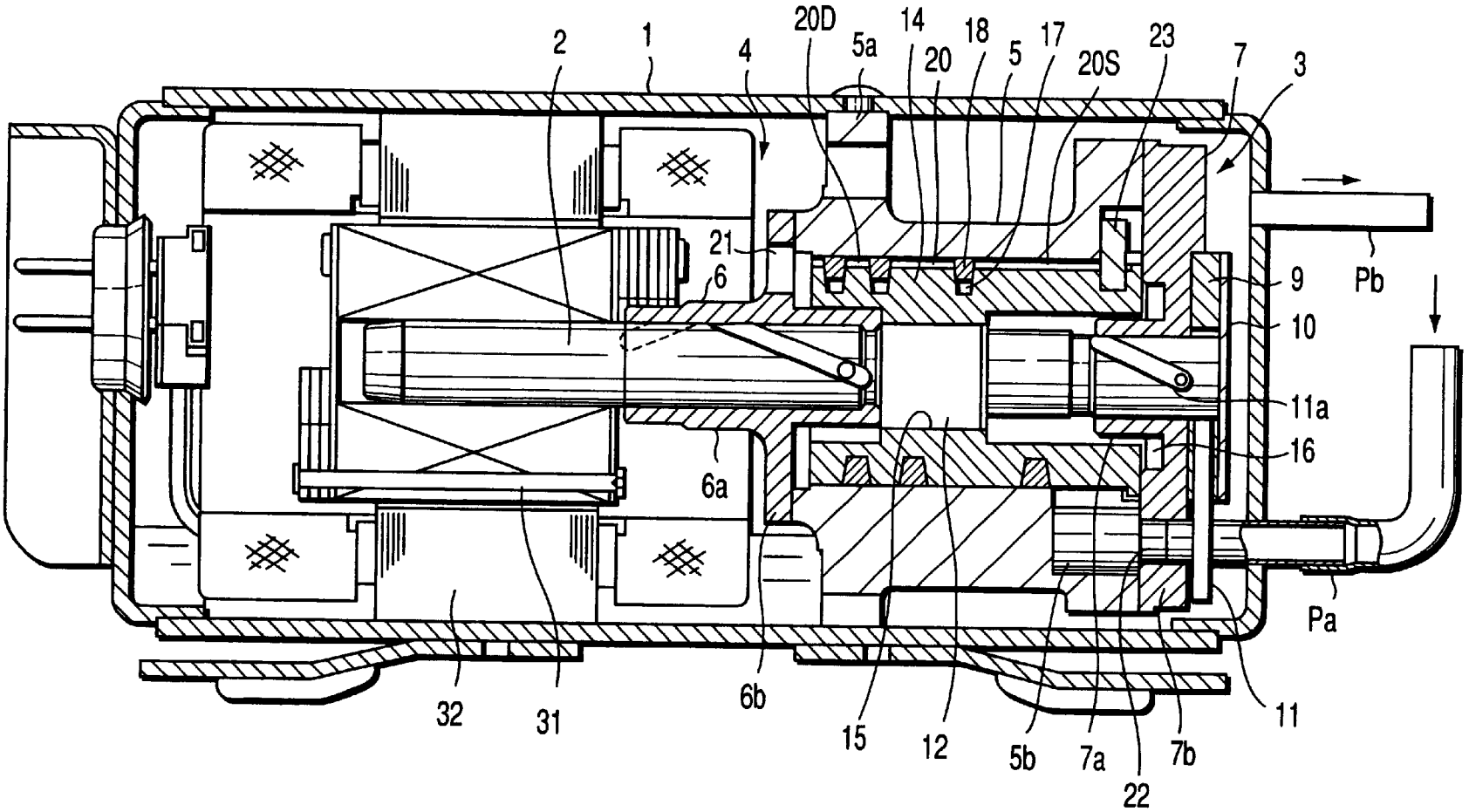
FIG. 1 is a cross-sectional view of a helical-blade type compressor according to an embodiment of the invention, which is a fluid compressor.
Figure 2:
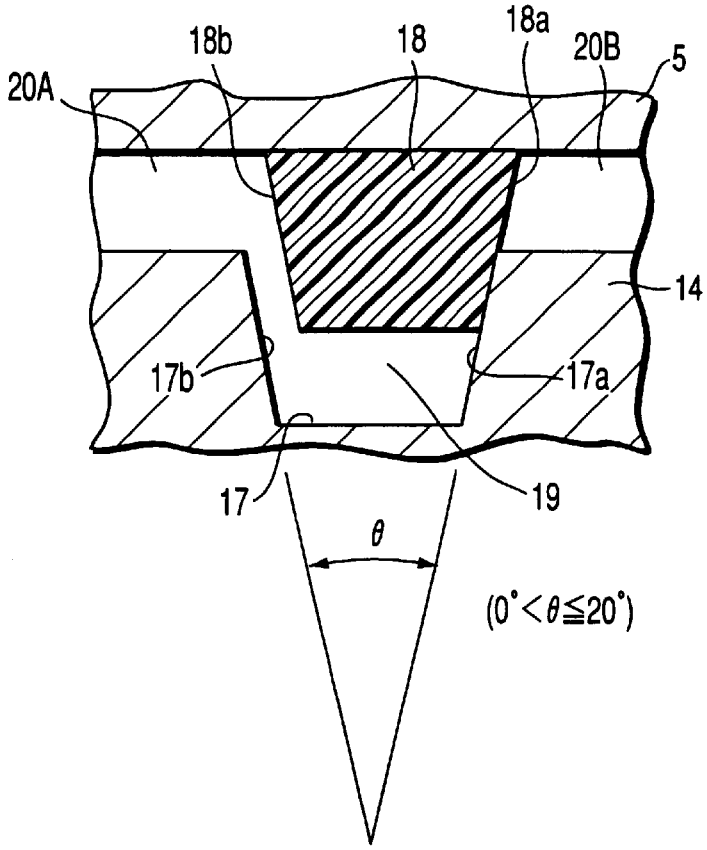
FIG. 2 is a cross-sectional view, showing the helical groove and the blade.
Figure 3:
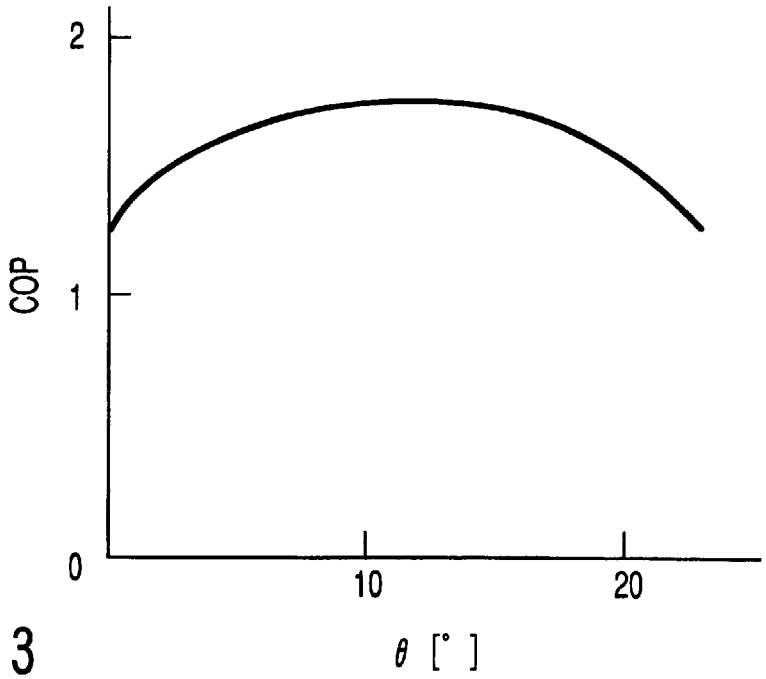
FIG. 3 is a characteristic diagram representing the relation between the opening angle of the groove and the compression efficiency (COP)

FIGS. 1 to 3 show the first embodiment of the present invention. FIG. 1 depicts a so-called "horizontal helical-blade type compressor," which is a fluid compressor. This helical-blade type compressor comprises a closed case 1 extending horizontally, a shaft 2 held in the closed case 1 and having a horizontal axis, a compression mechanism unit 3, and an electric motor unit 4. The shaft 2 connects the compression mechanism unit 3, or the right-side unit, to the electric motor unit 4, or the left-side unit.

A coolant inlet pipe Pa is coupled to one end of the closed case 1, or to a lower part of the end. A coolant outlet pipe Pb is coupled to this end of the closed case 1, or to an upper part of the end. Outside the case 1, the inlet pipe Pa and the outlet pipe Pb are connected by a condenser, an expansion valve and an evaporator (not shown). The pipes Pa and Pb, condenser, expansion valve and evaporator constitute the refrigeration cycle of, for example, an air conditioner.

The compression mechanism unit 3 will be described in detail. As FIGS. 1 and 2 show, a cylinder 5 is provided. The cylinder 5 has a flange 5*a* formed integral with and protruding from one end. The flange 5*a* is fitted, contacting the inner circumferential surface of the closed case 1, and is secured to the case 1 by, for example, welding performed on the outer circumferential surface of the case 1.

The cylinder 5 opens at the left and right ends. A main bearing 6 is fitted in the left end of the cylinder 5. A sub-bearing 7 is fitted in the right end of the cylinder 5.

The main bearing 6 comprises a boss part 6*a* and a flange part 6*b*. The boss part 6*a* supports the middle part of the shaft 2, allowing the shaft 2 to rotate freely. The flange part 6*b* is formed integral with one end of the boss part 6*a*. It protrudes from the boss part 6*a* and closes the open end of the cylinder 5.

The sub-bearing 7 comprises a boss part 7*a* and a flange part 7*b*. The boss part 7*a* supports one end portion of the shaft 2, allowing the shaft 2 to rotate freely. The flange part 7*b* is formed integral with the boss part 7*a* and closes the open end of the cylinder 5.

The coolant inlet pipe Pa extends into the closed case 1, passing through the end of the closed case 1. Its distal end is connected to a connection hole 22 that is made in the flange part 7*b* of the sub-bearing 7. The cylinder 5 has an inlet-pipe guiding recess 5*b* made in one end. The recess 5*b* opposes the connection hole 22.

A lubricant-guiding plate 9 and a closing plate 10 are secured to the outer surface of the sub-bearing 7 with fixture members. An oil-pumping pipe 11 is connected to the lubricant-guiding plate 9. Lubricant oil is pumped up from the bottom of the closed case 1 and applied into the oil-guiding groove 11*a* cut in the outer circumferential surface of the shaft 2. The closing plate 10 abuts on the end of the shaft 2, closing the open part of the guiding plate 9.

An eccentric crank 12 is formed integral with the shaft 2 and positioned between the boss part 6*a* of the main bearing 6 and the boss part 7*a* of the sub-bearing 7. The eccentric crank 12 has its axis deviated by a prescribed distance from the axis of the shaft 2.

A roller 14 is eccentrically arranged in the cylinder 5. Its axis is deviated from the axis of the shaft 2 by the same distance as the axis of the roller 14 is deviated. The roller 14 has an axial length a little smaller than that of the cylinder 5. A part of the outer circumferential surface of the roller is set in rolling contact, along an axial direction, with the inner circumferential surface of the cylinder 5.

The roller 14 has a support hole 15. The eccentric crank 12 of the shaft 2 is inserted in the support hole 15 and can rotate. The eccentric crank 12 rotates as the shaft 2 rotates. As a result, the roller 14 performs an eccentric rotation.

An Oldham mechanism 16 lies between the flange part 7*b* of the sub-bearing 7 and the lower part of the roller 14. The Oldham mechanism 16 makes the roller 14 to revolve, preventing it from undergoing rotation.

A helical groove 17 is made in the outer circumferential surface of the roller 14. The turns of the groove 17 are arranged at a pitch that gradually decreases from the right end of the roller 14 toward the left end thereof. A helical blade 18 is fitted in the helical groove 17 and can move in the depth direction of the helical groove 17.

The outer peripheral surface of the blade 18 lies in close contact with the inner circumferential surface of the cylinder 5. The helical groove 17 and the blade 18 have specific cross sections, which will be described later in detail.

The blade 18 is made of synthetic resin, such as fluororesin, which provides smooth surfaces. Its inside diameter is larger than the diameter of the roller 14. The blade 18 has been fitted into the helical groove 17 by forcedly reducing the diameter of the blade 18.

Thus, the blade 18 is incorporated, together with the roller 14, in the cylinder 5, with its outer peripheral surface kept in resilient contact with the inner circumferential surface of the cylinder 5.

As the shaft 2 rotates, the position at which the roller 14 assumes rolling contact with the inner circumferential surface of the cylinder 5 gradually moves in the circumferential direction of the cylinder 5. At the rolling-contact position, the blade 18 moves toward the bottom of the helical groove 17 until its outer peripheral surface becomes flush with the inner circumferential surface of the roller 14.

At any other position than the rolling-contact position, the blade 18 moves protrudes from the helical groove 17, more or less in accordance with the distance from the rolling-contact position. At the position away from the rolling-contact position by 180° in the circumferential direction, the blade 18 projects by a maximum distance (or a maximum height). Thereafter, the blade 18 approaches the rolling-contact position. Hence, the blade 18 repeats the motion described above.

In a plane extending along the diameters of the cylinder 5 and roller 14, the roller 14 is eccentric with respect to the cylinder 5. The roller 14 therefore has a part of its outer circumferential surface set in rolling contact with the inner circumferential surface of the cylinder 5. Hence, a space having a crescent cross section is provided between the cylinder 5 and the roller 14.

The blade 18 partitions the space between the outer circumferential surface of the roller 14 and the inner circumferential surface of the cylinder 5, into a plurality of spaces that are arranged in the axial direction of the roller 14. These spaces are continuous to one another, defining a helical space extending around and along the outer circumferential surface of the roller 14.

These spaces are called "compression chambers 20."Because of the varying pitch of the turns of the helical groove 17, each compression chamber 20 has a smaller volume than the immediately adjacent chamber 20 that is more close to the left end of the roller 14.

The rightmost compression chamber 20 faces an inlet section 20S that communicates with the inlet-pipe guiding recess 5*b* made in the cylinder 5 and the connection hole 22 of the coolant inlet pipe Pa. The leftmost compression chamber 20 faces an outlet section 20D that communicates with a coolant outlet hole 21 made in the flange part 6*b* of the main bearing 6.

The cylinder 5 has a blade stopper 23 that opposes the blade 18. The blade 18 moves, projecting from and sinking into the helical groove 17 as the roller 14 revolves. At the same time, a force acts on the blade 18 to pull the blade 18 from the end of the helical groove 17. The blade 18 abuts, at its end, on the blade stopper 23. The end portion of the blade 18 is therefore prevented from projecting from the helical groove 17.

The electric motor unit 4 comprises a rotor 31 and a stator 32. The rotor 31 is mounted on the shaft 2. The stator 32 is secured to the inner circumferential surface of the rotor 31. It faces the circumferential surface of the rotor 31, with a narrow gap provided between it and the rotor 31.

The helical groove 17 and the blade 18 have specific cross-sections, as will be described below.

As FIG. 2 shows, the cross section that the helical groove 17 has in a plane extending at right angles to its axis has two sides 17*a* and 17*b*.

The sides 17*a* and 17*b* lie adjacent to a low-pressure compression chamber 20B and a high-pressure compression chamber 20A, respectively. The sides 17*a* and 17*b* are inclined such that the groove 17 gradually opens toward its top. Hence, the cross section is shaped like an inverted trapezoid, having a base shorter than the top.

The sides 17*a* and 17*b* of the helical groove 17 define an opening angle θ, which satisfies the following formula (1):

$$0° < \theta \leqq 20° \quad (1)$$

The formula (1) derives from the relation between the opening angle and the compression efficiency (COP: coefficient of performance), which is illustrated in FIG. 3.

In the helical-blade type compressor of the structure described above, the rotor 31 is rotated, rotating the shaft 2, by supplying electric power is supplied to the electric motor unit 4. The shaft 2 rotates the eccentric crank 12, which drives the roller 14.

The Oldham mechanism 16 makes the roller 14 to revolve, preventing it from undergoing rotation. As the roller 14 revolves, the rolling-contact position, at which the roller 14 contacts has its outer circumferential surface contacting the cylinder 5 gradually moves in the circumferential direction. The blade 18 moves along the diameter of the roller 14, protruding from and sinking into the helical groove 17.

As this sequence of operation proceeds, the coolant gas at a low pressure is drawn from the evaporator through the coolant inlet pipe Pa, into the compression chamber 20 that faces the inlet section 20S. As the roller 14 rotates, the coolant gas is supplied into the compression chamber 20 that faces the outlet section 20D.

Any compression chamber 20 that faces outlet section 20D has a smaller volume than the adjacent chamber 20 that faces the inlet section 20S. Therefore, the coolant gas is compressed as it is supplied from one compression chamber to the next one. It gains the prescribed high pressure in the compression chamber 20 that faces the leftmost outlet section 20D. The high-pressure gas is applied from this compression chamber 20 into the condenser through the coolant outlet hole 21 and the outlet pipe Pb. Thus, a refrigeration-cycle operation of the known type is accomplished.

The blade 18 has a cross section that is shaped like an inverted trapezoid, similar to the cross section of the helical groove 17. As FIG. 2 shows, the sides 18*a* and 18*b* of the blade 18, which lie adjacent to a low-pressure compression chamber 20B and a high-pressure compression chamber 20A, respectively, are inclined at the same angle as the sides 17*a* and 17*b* of the helical groove 17.

As indicated above, the helical groove 17 has a cross section shaped like an inverted trapezoid, in a plane that extends at right angles to its axis. The sides 17*a* and 17*b*, which lie on a low-pressure side and a high-pressure side, respectively, are inclined such that the groove 17 gradually opens toward its top. The opening angle θ is $0° < \theta \leqq 20°$ as defined in the formula (1).

Therefore, a gap is provided between the side 18*b* of the blade 18, which lies adjacent to the high-pressure compression chamber 20*a*, and the side 17*b* of the helical groove 17, which opposes the side 18*b*, while the blade 18 remains projecting from the helical groove 17 as is illustrated in FIG. 2.

In this case, a space 19 at the bottom of the helical groove 17 reliably communicates with the high-pressure compression chamber 20A. The coolant gas in the space 19 therefore acquires the same pressure as the coolant gas in the high-pressure compression chamber 20A. This increases the compression efficiency. Further, the blade 18 would not be prevented from smoothly moving, because no excessive pressure acts on the blade 18.

FIG. 3 shows the relation between the opening angle θ and the compression efficiency (COP: coefficient of performance). The greater the opening angle θ, the larger the space 19 at the bottom of the helical groove 17 becomes and the more reliably it communicates with the high-pressure compression chamber 20A. It was confirmed that COP remarkably increased when the opening angle θ of the helical groove 17 was: $0° < \theta \leqq 20°$. It is preferred that the opening angle θ be 0.5° or more.

Figure 4:
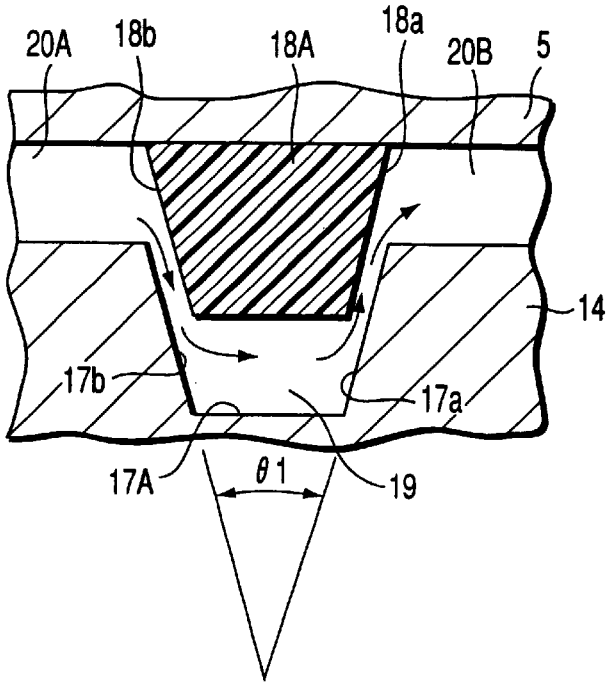
FIG. 4 is a cross-sectional view depicting a helical groove and a blade, the groove having sides that define an angle greater than 20°.

FIG. 4 depicts a helical groove 17A that has an opening angle $\theta_1$ that is much larger than the upper limit of the range defined by the formula (1). In this case, the angle defined by the sides of the blade 18A is set at the same value as the opening angle of the helical groove 17A.

Since the opening angle $\theta_1$ of the helical groove 17A is much greater than 20°, the gap between the side 17*a* of the groove 17A and the side 18*a* of the blade 18A and the gap between the side 17*b* of the groove 17A and the side 18*b* of the blade 18A are inevitably large when the blade 18A protrudes most from the helical groove 17A.

In this condition, the blade 18A can hardly be deformed. The side 18*a* of the blade 18A cannot closely contact the side 17*a* of the helical groove 17A. There remains a gap between the side 18*a* and the side 17*a*. This degrades the sealing property.

Figure 5:
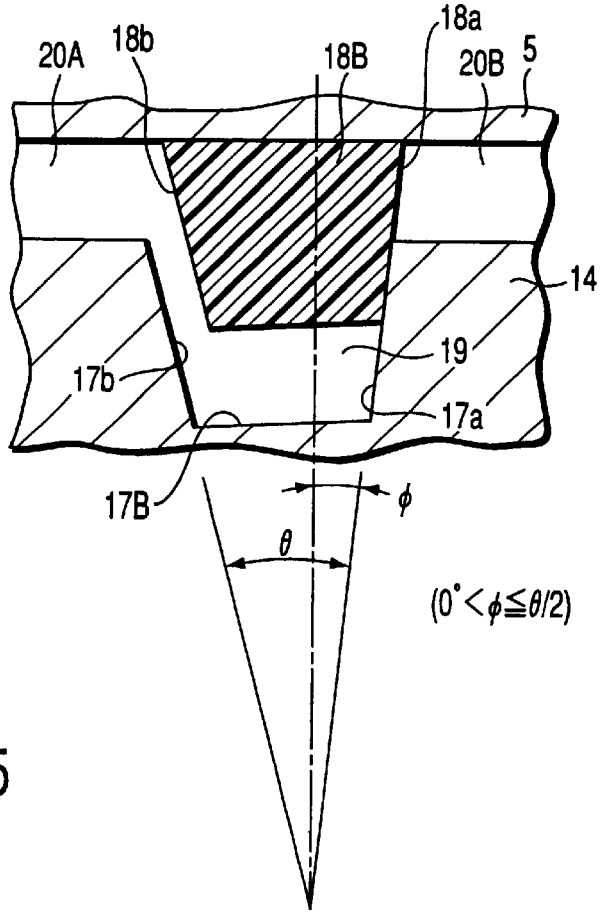
FIG. 5 is a cross-sectional view, showing the helical groove and blade of a second embodiment of this invention.

FIG. 5 shows the second embodiment of the invention. In this embodiment, the helical groove 17B has an opening angle θ that falls within the range defined by the formula (1) and the side 17*a* of the groove 17B and side 18*a* of the blade 18B are inclined at an angle φ that is defined by the following formula (2):

$$0° < \phi \leqq \theta/2 \tag{2}$$

Hence, the helical groove 17B has a specific opening angle θ and defines a small gap between its low-pressure side 17*a* and the low-pressure side 18*a* of the blade 18 when the blade 18B most protrudes from the helical groove 17B.

The low-pressure side 18*a* of the blade 18B is therefore pressed onto the low-pressure side 17*a* of the helical groove 17B. This can enhance the sealing property. Thus, the sealing property would not decrease as has been explained with reference to FIG. 4.

If $\phi = \theta/2$ in the formula (2), that is, the low-pressure side 17*a* and high-pressure side 17*b* of the helical groove 17B are inclined at the same angle, the helical groove 18B can be easily cut with a tool (e.g., end mill or the like) which has an inclined edge.

Figure 6:
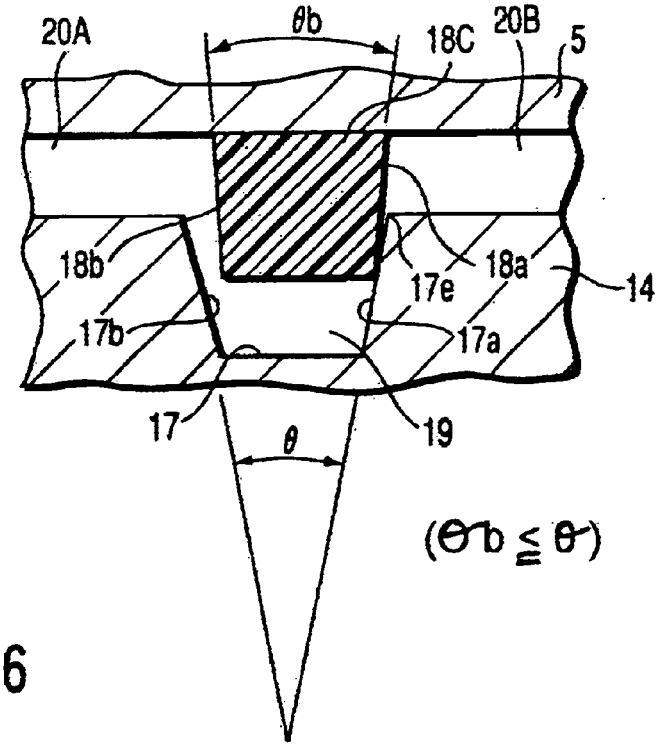
FIG. 6 is a cross-sectional view, illustrating the helical groove and blade of a third embodiment of the invention.

FIG. 6 shows the third embodiment of this invention. The opening angle θ of the helical groove 17 falls within the range specified by the formula (1) and explained with reference to FIG. 2. However, the angle $\theta_b$ defined by the sides 18*a* and 18*b* of the blade 18C is different from the opening angle θ of the helical groove 17.

As seen from the cross section of the blade 18C, taken along line extending at right angles to the axis of the blade, the opening angle $\theta_b$ defined by the low- and high-pressure sides 18*a* and 18*b* of the blade 18C has the following relation with the opening angle θ of the helical groove 17:

$$\theta_b \leqq \theta \tag{3}$$

Thus, the upper edge of the side 17*a* of the helical groove 17 does not contact the side 18*a* of the blade 18C even if the blade 18C most protruding from the helical groove 17 is pressed onto the low-pressure side 17*a* of the helical groove 17. This mitigates the concentration of stress at the upper edge 17*e* of the side 17*a*. Fast wear of the blade 18C can therefore be prevented, which improve the reliability of the compressor.

Figure 7:
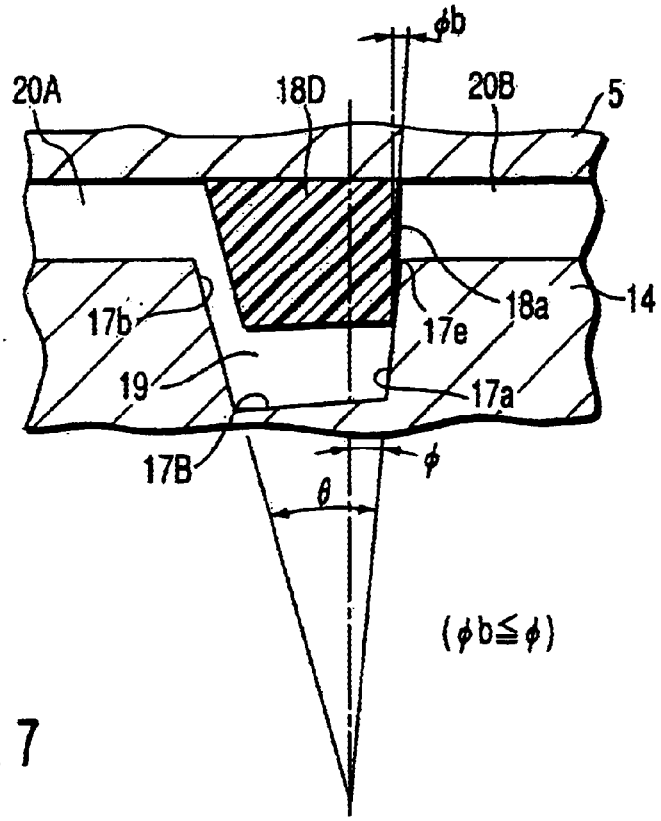
FIG. 7 is a cross-sectional view, displaying the helical groove and blade of a fourth embodiment of the present invention.

FIG. 7 displays the fourth embodiment of the present invention. The helical groove 17B has its low-pressure side 17*a* inclined at an angle φ that satisfies the formula (2), as in the second embodiment described with reference to FIG. 5.

The low-pressure side 18*a* of the blade 18D is inclined at an angle $\phi_b$ that has the following relation with the inclination angle φ of the low-pressure side 17*b* of the helical groove 17B:

$$\phi_b \leqq \phi \tag{4}$$

Hence, the upper edge 17*e* of the side 17*a* does not contact the low-pressure side 18*a* of the blade 18D even if the blade 18D most protruding from the helical groove 17B is pressed onto the low-pressure side 17*a* of the helical groove 17B. This mitigates the concentration of stress at the upper edge 17*e* of the side 17*a*. Fast wear of the blade 18C can therefore be prevented, which improve the reliability of the compressor.

Figure 8:
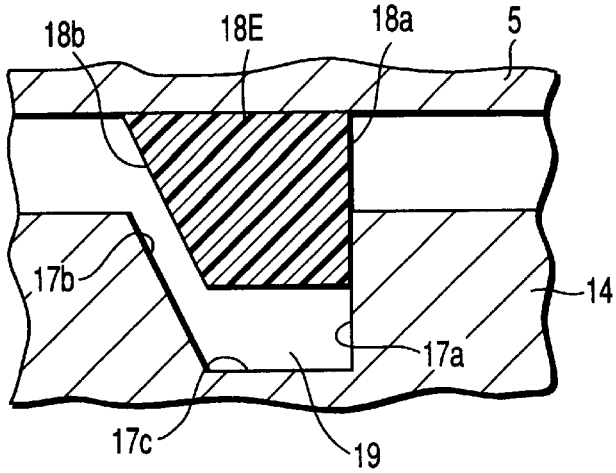
FIG. 8 is a cross-sectional view, showing the helical groove and blade of a fifth embodiment of this invention.
Figure 9:
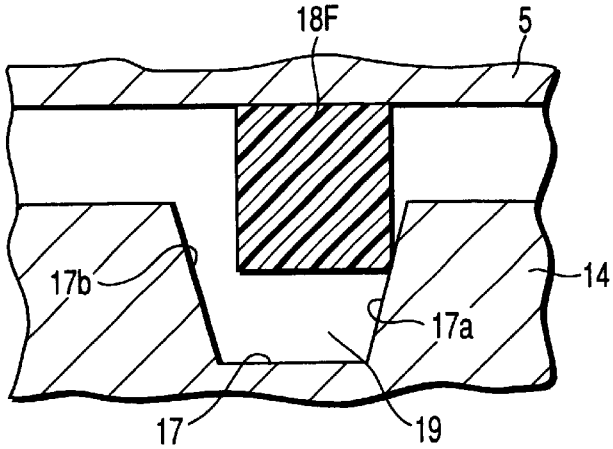
FIG. 9 is a cross-sectional view, illustrating the helical groove and blade of a sixth embodiment of the invention.
Figure 10:
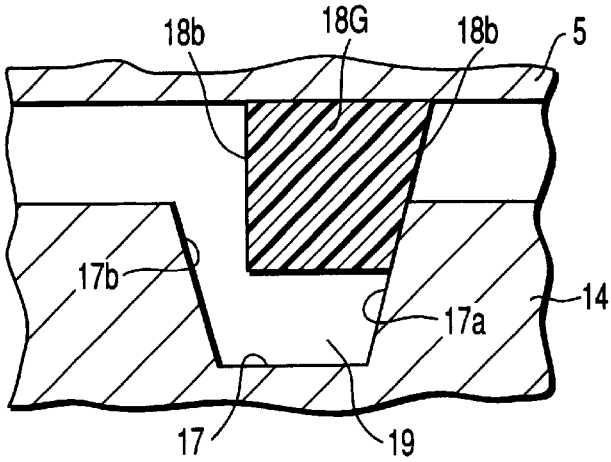
FIG. 10 is a cross-sectional view, depicting the helical groove and blade of a seventh embodiment of this invention.
Figure 11:
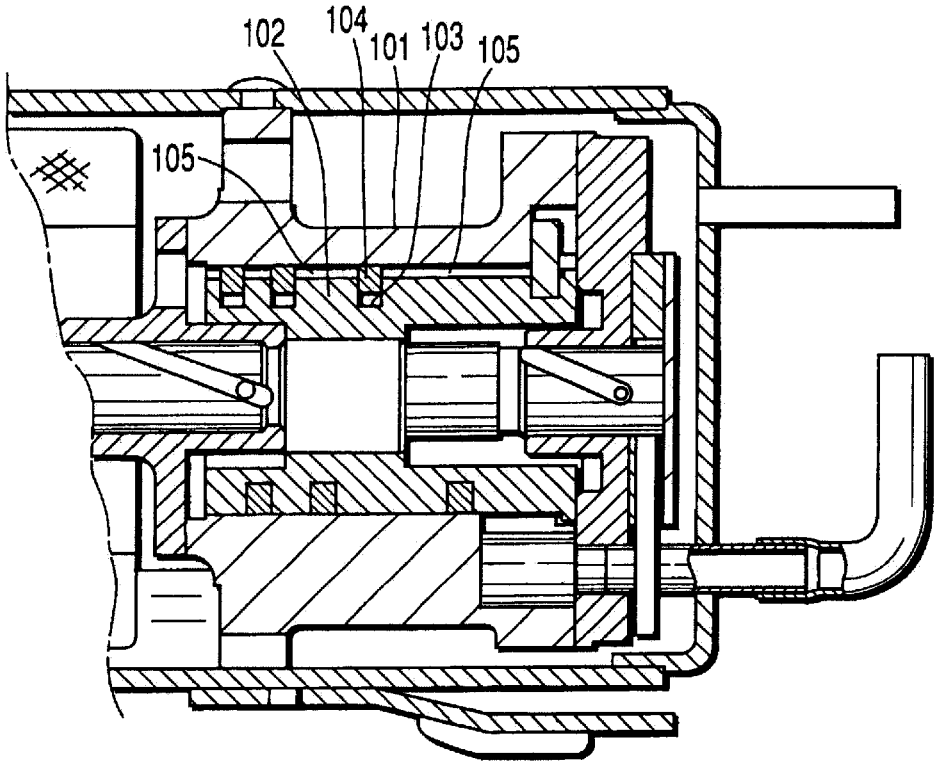
FIG. 11 (PRIOR ART)
FIG. 11 is a cross-sectional view of a conventional helical-blade type compressor, which is a fluid compressor.
Figure 12:
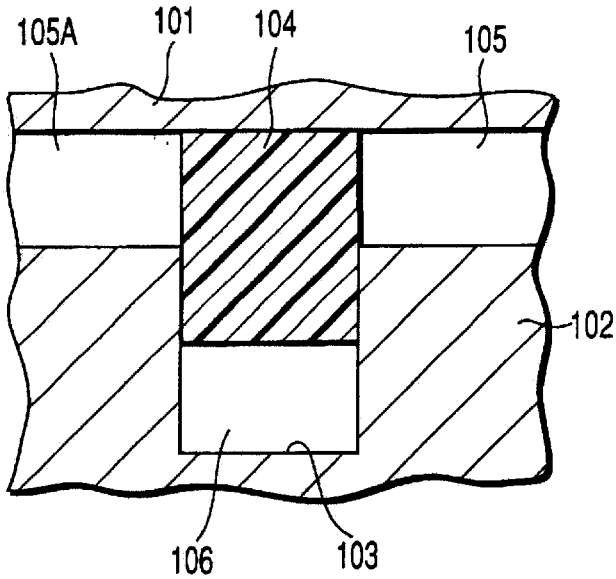
FIG. 12 (PRIOR ART)
FIG. 12 is a cross-sectional view showing the helical groove and blade of the conventional compressor.

FIGS. 8 to 10 show the fifth, sixth and seventh embodiments of the invention, respectively.

In the fifth embodiment shown in FIG. 8, the low-pressure side 17*a* of the helical groove 17C and the low-pressure side 18*a* of the blade 18E are inclined at 0°. Namely, they stand almost vertically.

The sixth embodiment shown in FIG. 9 is similar in shape to the first embodiment illustrated in FIG. 2. Nonetheless, the sides 18*a* and 18*b* of the blade 18F are inclined at 0°, extending parallel to each other.

The seventh embodiment shown in FIG. 10 is similar in shape to the first embodiment illustrated in FIG. 2. Nonetheless, of the two opposing sides 18*a* and 18*b* of the blade 18G, only the low-pressure side 18*a* is inclined at a prescribed angle. The high-pressure side 18*b* is inclined at 0°, extending almost vertically.

Like the first to fourth embodiments, the fifth to seventh embodiments can have its compression efficiency improved, because the high-pressure compression chamber 20A reliably communicates with the space 19 at the bottom of the helical groove 17C (17). In addition, the blades 18E to 18G can provide sufficient sealing property.

Needless to say, the angle θ defined by the sides 17*a* and 17*b* of the helical groove 17C or 17 satisfies the formula (1) in the embodiments of FIGS. 8 to 10.

The helical-blade compressors described above are of the type in which the roller revolves. This invention is not limited to this type, nevertheless. The invention can be applied to helical-blade type compressors in which the roller rotates together with the cylinder.

As has been described, the space at the bottom of the helical groove reliably communicates with the high-pressure compression chamber in the present invention. This can not only enhance the compression efficiency, but also enable the blade to move smoothly into and from the helical groove, helping to increase the sealing property. Moreover, the blade can be easily fitted into the helical groove, which increases the assembling efficiency.

What is claimed is:

1. A fluid compressor for compressing fluid, comprising:

a hollow cylinder;

a roller provided in the cylinder, with an axis deviated from the axis of the cylinder, and having a helical groove made in an outer circumferential surface and having turns arranged at a pitch that gradually increases from one end to the other end;

a blade fitted in the helical groove of the roller and being movable with respect to the helical groove; and a plurality of compression chambers provided between the cylinder and the roller, defined by the blade and designed to compress the fluid to a high pressure gradually as the fluid flows in an axial direction of the roller, from one end to the other end of the roller, wherein the helical groove has one side positioned at a high-pressure compression chamber and another side positioned at a low-pressure compression chamber, and said one side and said another side are inclined at the same angle such that the groove gradually opens toward the outer circumferential surface of the roller, an opening angle θ defined by said one side and another side is:

$$0° < \theta \leqq 20°,$$

the blade has one side positioned at a high-pressure compression chamber and another side positioned at a low-pressure compression chamber, and both sides of the blade are inclined at substantially the same angle as both sides of the helical groove.

* * * * *